US006334310B1

(12) United States Patent
Sutcu et al.

(10) Patent No.: US 6,334,310 B1
(45) Date of Patent: Jan. 1, 2002

(54) FRACTURE RESISTANT SUPPORT STRUCTURE FOR A HULA SEAL IN A TURBINE COMBUSTOR AND RELATED METHOD

(75) Inventors: Maz Sutcu, Niskayuna; Bernard Arthur Couture, Latham; Sami Aslam, Clifton Park, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/586,043

(22) Filed: Jun. 2, 2000

(51) Int. Cl.[7] ..... F02C 1/00
(52) U.S. Cl. ..... 60/752; 29/888.061; 228/164
(58) Field of Search ..... 60/752, 760; 29/888.061; 228/164, 165, 173.1

(56) References Cited

U.S. PATENT DOCUMENTS 3,938,323 A * 2/1976 Quigg et al. ..... 60/39.74
5,349,817 A * 9/1994 Bekkering ..... 60/323
6,134,877 A * 10/2000 Alkabie ..... 60/39.32

* cited by examiner

*Primary Examiner*—Charles G. Freay
(74) *Attorney, Agent, or Firm*—Nixon & Vanderhye P.C.

(57) ABSTRACT

A combustion liner and cooling sleeve assembly for a turbine combustor includes a substantially cylindrical combustion liner; and a substantially cylindrical outer cooling sleeve surrounding at least an axial portion of the combustion liner; wherein the outer cooling sleeve is secured to the combustion liner by a weld at one end of the cooling sleeve at its aft end, with a predetermined radial gap therebetween, the gap determined by respective operating temperatures and thermal expansion coefficients. A method of reducing crack propensity in a substantially cylindrical combustion liner and substantially cylindrical cooling sleeve assembly where one end of said cooling sleeve is welded to the combustion liner, includes the steps of: a) determining a radial gap between the combustion liner and the outer cooling sleeve as a function of operating temperatures and thermal expansion coefficients of the liner and the cooling sleeve; b) forming the outer cooling sleeve with a diameter sufficient to provide the radial gap; c) swaging the outer end of the cooling sleeve to bring the end of the outer cooling sleeve into engagement With the combustion liner; and d) welding the outer cooling sleeve to the combustion liner.

32 Claims, 2 Drawing Sheets

FRACTURE RESISTANT SUPPORT STRUCTURE FOR A HULA SEAL IN A TURBINE COMBUSTOR AND RELATED METHOD

BACKGROUND OF THE INVENTION

This invention relates to gas turbine combustors, and particularly to a fracture resistant support structure for a so-called "hula seal" between a combustion liner and a transition piece. The support structure is placed between the hula seal and combustion liner.

Current combustion liner cooling sleeves are attached at their forward ends to the radially inner combustor liner with a circumferential fillet weld (either intermittent or continuous). For purposes of this discussion, the "aft" end is that which is closer to the exit face of the liner, while the "forward" end is that which is closer to the inlet of the liner. Generally, the liner runs hotter than the outer sleeve by 300–500°F., because the liner is exposed directly to the hot combustion gases. More specifically, the liner temperature is typically in the 1200–1400° F. range, whereas the outer sleeve temperature is typically in the range of 700–900° F. If the initial radial gap between the sleeve and liner is set to zero, then the liner will expand more than the outer sleeve, and will therefore create compressive radial stresses at the interface, and tensile hoop stresses in the outer sleeve. The resulting thermally induced deformations cause hoop extension such that the outer sleeve diameter increases to the extent that the sleeve is permanently deformed. During the cooling cycle, however, the liner contracts but the outer sleeve cannot return to its original diameter due to the permanently set deformation. The inability of the outer sleeve to recover its original shape creates a radial gap which acts as a crack opening displacement, impinging on the fillet weld. This crack opening displacement may increase the stress intensity factor to the critical stress intensity factor (KIC) in order to drive the crack into the weld.

BRIEF SUMMARY OF THE INVENTION

In the present invention, the outer sleeve is made slightly oversized to produce a radial gap between the liner and the outer sleeve at ambient temperature. The gap is calculated by considering the operating temperatures of both components and their respective thermal expansion coefficients. The calculated value is the value that will create no thermal mismatch stresses. Once the gap is determined, the outer sleeve can be formed with the appropriate diameter. The aft end of the outer sleeve is swaged inwards an amount equal to the gap value to insure that the edge of the outer sleeve touches the liner. After welding prep is applied, the outer sleeve is welded over the liner. Because of the swaged end, the crack tip that impinges on the fillet weld is no longer infinitely sharp. Rather, a blunt crack tip is provided that reduces the stress intensity factor in the weld, and thus reduces the propensity for cracking.

To further reduce the crack driving energy, the outer sleeve may be separated into multiple segments at the welded end. Each segment is welded with an independent fillet weld so that the fracture energy in each segment is limited, and the segments are flexible during thermal growth. These segments are positioned with respect to axial slots in the liner and the in respective cooling holes in the outer sleeve.

In one embodiment, the axial channels in the liner are completely covered by the outer sleeve. The air inlet holes in the outer sleeve are placed over a circumferential channel which acts as a plenum and feeds air into the axial channels.

In a second embodiment, the axial channels extend beyond the length of the outer sleeve. The exposed length of the axial channels provides air inlet locations, thus replacing the inlet holes of the previous design.

The number or location of the segments can be independent of the number and location of the axial channels and the location of air inlet holes.

Accordingly, in its broader aspects, the present invention relates to a combustion liner and outer cooling sleeve assembly for a turbine combustor comprising a substantially cylindrical combustion liner having a forward end and an aft end; and a substantially cylindrical outer cooling sleeve surrounding at least an axial portion of the combustion liner; wherein the outer cooling sleeve is secured to the combustion liner by a weld at an end of the outer cooling sleeve, with a predetermined radial gap between the combustion liner and the outer cooling sleeve extending at least partially about the combustion liner, the radial gap determined by respective operating temperatures and thermal expansion coefficients of the combustion liner and the outer cooling sleeve.

In another aspect, the invention relates to a combustion liner and cooling sleeve assembly for a turbine combustor comprising a substantially cylindrical combustion liner; and a substantially cylindrical cooling sleeve surrounding at least an axial portion of the combustion liner; wherein the outer cooling sleeve is secured to the combustion liner by a weld at one end of the outer cooling sleeve, with a predetermined radial gap between the combustion liner and the cooling sleeve; wherein the end is circumferentially divided into segments and wherein the weld is continuous in each segment; and further wherein the end is swaged radially inwardly an amount equal to the radial gap such that the end engages an outer surface of the combustion liner.

In still another aspect, the invention provides a method of reducing crack propensity in a substantially cylindrical combustion liner and substantially cylindrical outer cooling sleeve assembly where one end of the outer cooling sleeve is welded to the combustion liner, the method comprising a) determining a radial gap between the combination liner and the outer cooling sleeve as a function of operating temperatures and thermal expansion coefficients of the combustion liner and the cooling sleeve; b) forming the outer cooling sleeve with a diameter sufficient to provide the radial gap; c) swaging the end of the outer cooling sleeve to bring the end into engagement with the combustion liner; and d) welding the outer cooling sleeve to the combustion liner about the end.

DETAILED DESCRIPTION OF THE INVENTION

Figure 1:
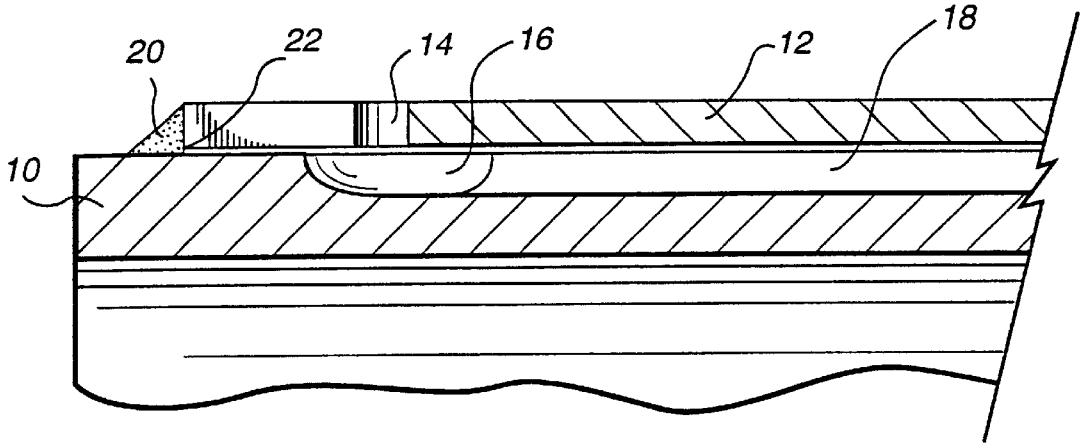
FIG. 1 PRIOR ART
FIG. 1 is a partial cross section illustrating a conventional interface between a combustor outer cooling sleeve and an inner combustor liner.

FIG. 1 illustrates, in partial section, the aft end of a current combustor liner 10 and a surrounding outer cooling sleeve 12. The radially outer cooling sleeve 12 is provided with a circumferentially arranged row of cooling holes 14 (one shown but two or more rows can be utilized) that permits cooling air to impinge on the liner 10. The liner 10 is provided with a circumferential groove 16 in axial alignment with the row of cooling holes 14, and a plurality of axially extending, circumferentially spaced cooling channels 18 communicate at one end with the groove 16.

The outer cooling sleeve 12 is attached to the liner with a circumferential fillet weld 20 which may be an intermittent or "stitch" weld, or a continuous 360° weld.

Notice that there is essentially no radial gap between the liner 10 and outer sleeve 12, and also note the sharp crack tip at 22. With this design, the first heated liner 10 pushes the outer cooling sleeve 12 radially outwardly, causing plastic deformation in the outer sleeve. When cooled, the liner shrinks inwardly away from the permanently deformed sleeve, pulling away at the weld 20 causing a crack to develop, made worse by the sharp crack tip at 22. As the liner shrinks away, the entire length of the outer sleeve develops a resisting spring force which creates elastic energy in the body. This elastic "spring" energy is available for crack propagation at the weld.

Figure 2:
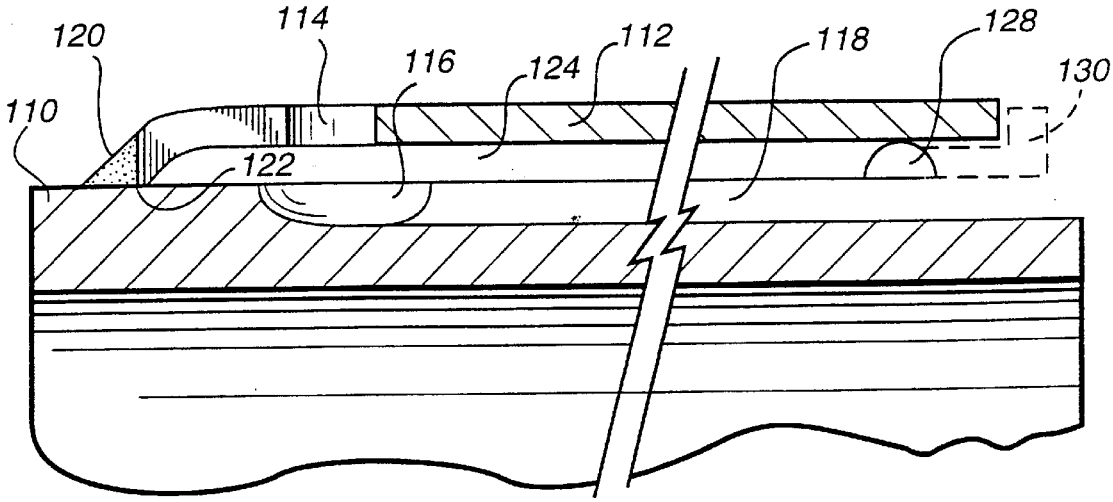
FIG. 2 is a partial cross section illustrating an interconnection between an outer cooling sleeve and an inner combustor liner in accordance with an exemplary embodiment of this invention.
Figure 3:
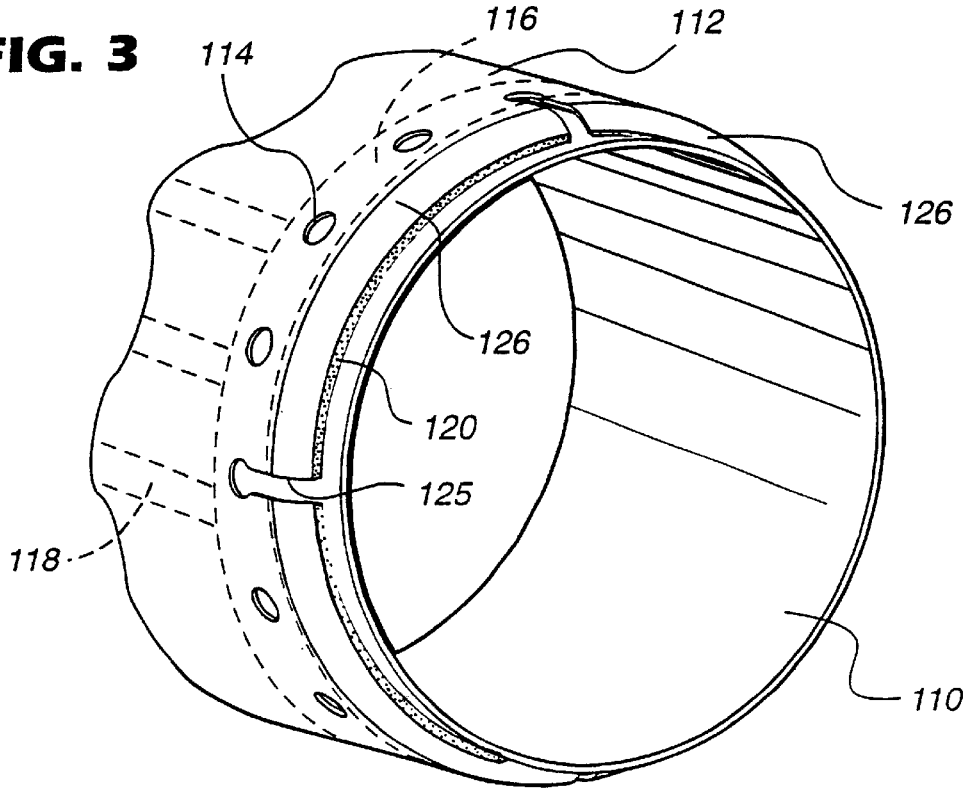
FIG. 3 is a perspective view of the interface between the outer cooling sleeve and the inner combustor liner in accordance with an exemplary embodiment of the invention.

Turning to FIGS. 2 and 3, an exemplary embodiment of this invention is illustrated and, for convenience, certain reference numerals similar to those in FIG. 1, but with the prefix "1" added, are used to identify corresponding components. The combustion liner 110 is surrounded by an outer cooling sleeve 112. A circumferential row of cooling holes 114 supply cooling air to the liner, the air impinging on a circumferential cooling groove 116 that supplies air to the axially extending cooling channels 118. In this design, however, the outer sleeve 112 is made slightly oversize, creating a radial air gap 124 between the liner and the sleeve. The aft end of the sleeve 112 must then be swaged inwards an amount equal to the gap to ensure that the edge of the sleeve engages the liner. Welding prep is applied, based on the fillet weld size, and the outer sleeve 112 is welded over the liner, with weld 120 either a continuous 360° weld, or an intermittent stitch weld as best seen in FIG. 3.

Because of the swaged end of the outer sleeve 112, the crack tip 122 that impinges on the fillet weld is blunt, reducing the stress intensity factor in the weld, and thus reducing the propensity for cracking.

The radial gap 124 between the combustion liner 110 and the outer cooling sleeve 112 is calculated by considering the operating temperatures of both components and their respective thermal expansion coefficients (the latter may be the same or different).

An example of the thermal gap calculation is provided below:

Assumptions

Sleeve Material=Nimonic 263
Sleeve Temperature=850 deg. F.
Thermal Expansion at Temp=7.4e−6 in/in
Sleeve Young's Mod=28 e6 psi
Sleeve Thickness=0.040" for 7FA,
Liner Material=Nimonic 263
Liner Temperature=1350 deg. F.
Thermal Expansion at Temp=8.4e−6 in/in
Liner Young's Mod=24e6 psi
Liner Thickness (effective)=0.125" for 7FA,
Liner Outer Diam=14.−010" for 7FA, 13.895" for 9H
Crack Opening Displacement (COD), Radial Gap=(14/2)*(8.4e−6*(1400-70)−7.4e-6*(850-70))=0.0378 in.

As already noted, during operation, the combustion liner 110 expands more than the outer cooling sleeve 112. This is so even if the thermal expansion coefficients are the same, because the liner 110 is considerably hotter (e.g., 1400° F. vs. 900° F.). In any event, the radial gap 124 provides room for thermal growth. As the combustion liner 110 expands, the gap will close, but not entirely, leaving a residual gap. As a result, the outer cooling sleeve 112 is not deformed and both components regain substantially their original shapes upon cooling. This factor, along with the smooth bend at the weld 120 and the blunt crack tip geometry at 122, significantly reduces the likelihood of cracking.

It will be appreciated that the radial gap 124 need not extend a full 360° between the liner 110 and sleeve 112. The liner 110 and sleeve could be configured to create for example, a radial gap that extends only 180° (or any other suitable extent).

With specific reference to FIG. 3, the stitch weld 120 is interrupted by axial slots 125 originating in certain of the cooling holes 114, and defining the segments 126. The weld 120 is continuous within each segment, and the number of segments may vary (preferably four or more). Separating the forward end of the outer cooling sleeve 112 into multiple segments increases the flexibility of the weld connection. Separation also decreases the tendency for weld cracking because less elastic strain energy becomes available to the crack tip. By providing a circumferential groove 116, it will be appreciated that it is not necessary to align the cooling holes 114 with the axially extending channels 118.

Figure 4:
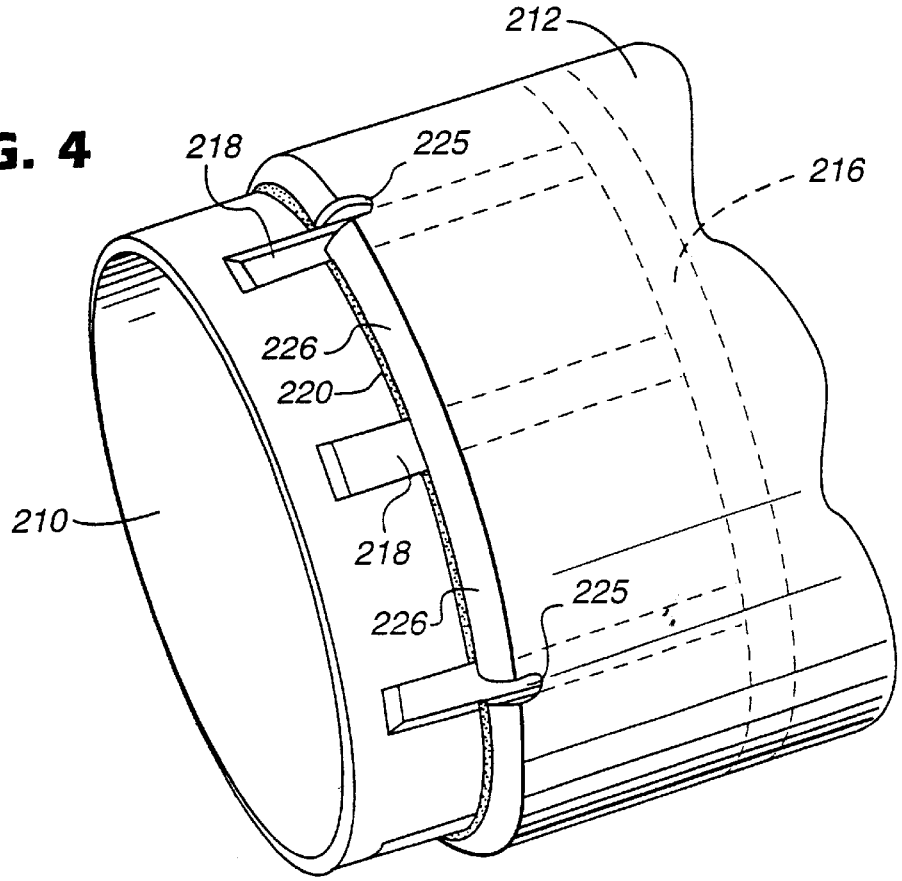
FIG. 4 is a partial perspective view of the interface between an outer cooling sleeve and an inner combustor liner in accordance with an alternative embodiment of the invention.

FIG. 4 illustrates a similar arrangement, but where the segments 226 of the outer cooling sleeve 212 are defined by notches or cut-outs 225. Radially inward of the segment cut-outs 225 are axial cooling channels 218 which extend axially forward and rearward of the stitch weld 220. These channels may communicate with a circumferential cooling groove 216 in the combustion liner 210.

Returning to FIG. 2, a preferably segmented centering ridge 128 may be machined in the outer surface of the combustion liner 110 or, alternatively, machined on the inner surface of the outer cooling sleeve 112. While there may be some localized deformation of the outer cooling sleeve 112 as the combustion liner 110 expands, it will not directly affect the remote weld 120. The ridge can also have an optional stop portion 130 that will prevent excessive axial movement of the outer cooling sleeve in the event of weld failure.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustion liner and outer cooling sleeve assembly for a turbine combustor comprising:

a substantially cylindrical combustion liner having a forward end and an aft end; and a substantially cylindrical outer cooling sleeve surrounding at least an axial portion of said combustion liner; wherein said outer cooling sleeve is inwardly formed at one end thereof and secured to said combustion liner by a weld at said one end of said outer cooling sleeve, to thereby establish a predetermined radial gap between said combustion liner and said outer cooling sleeve extending at least partially about said combustion liner, said radial gap determined by respective operating temperatures and thermal expansion coefficients of said combustion liner and said outer cooling sleeve.

2. The assembly of claim 1 wherein said weld is a continuous 360° weld about said one end.

3. The assembly of claim 1 wherein said one end is circumferentially divided into segments and wherein said weld is continuous in each segment.

4. The assembly of claim 1 wherein said one end is swaged inwardly an amount equal to said gap such that said end engages an outer surface of said combustion liner.

5. The assembly of claim 1 wherein said outer cooling sleeve has at least one circumferentially arranged row of cooling holes adjacent said one end.

6. The assembly of claim 5 wherein said combustion liner has a circumferentially extending cooling groove substantially axially aligned with said at least one row of cooling holes.

7. The assembly of claim 6 wherein said combustion liner is provided with one or more axially extending cooling channels communicating with said cooling groove.

8. The assembly of claim 3 wherein said segments are defined by circumferentially spaced axially extending slots.

9. The assembly of claim 8 wherein said outer cooling sleeve has at least one circumferentially arranged row of cooling holes adjacent said one end; and further wherein said axially extending slots communicate with respective ones of said cooling holes.

10. The assembly of claim 3 wherein said segments are defined by circumferentially spaced notches.

11. The assembly of claim 3 wherein said combustion liner is provided with circumferentially spaced, axially extending cooling grooves that extend forwardly and rearwardly of said weld.

12. The assembly of claim 1 wherein said thermal expansion coefficients are identical.

13. A combustion liner and cooling sleeve assembly for a turbine combustor comprising:

a substantially cylindrical combustion liner; and a substantially cylindrical cooling sleeve surrounding at least an axial portion of said combustion liner; wherein said outer cooling sleeve is secured to said combustion liner by a weld at one end of said outer cooling sleeve, with a predetermined radial gap between said combustion liner and said outer cooling sleeve; wherein said end is circumferentially divided into segments and wherein said weld is continuous in each segment; and further wherein said end is swaged radially inwardly an amount equal to said radial gap such that said end engages an outer surface of said combustion liner.

14. The assembly of claim 13 wherein said outer cooling sleeve has at least one circumferentially arranged row of cooling holes adjacent said end.

15. The assembly of claim 14 wherein said combustion liner has a circumferentially extending cooling groove substantially axially aligned with said at least one row of cooling holes.

16. The assembly of claim 7 wherein said liner is provided with one or more axially extending cooling channels communicating with said cooling groove.

17. The assembly of claim 8 wherein said segments are defined by axially extending slots.

18. The assembly of claim 17 wherein said outer cooling sleeve has at least one circumferentially arranged row of cooling holes adjacent said end; and further wherein said axially extending slots communicate with respective ones of said cooling holes.

19. The assembly of claim 13 wherein said segments are defined by notches.

20. The assembly of claim 13 wherein said combustion liner is provided with circumferentially spaced, axially extending cooling channels that extend forwardly and rearwardly of said weld.

21. The assembly of claim 13 wherein said thermal expansion coefficients are identical.

22. A method of reducing crack propensity in a substantially cylindrical combustion liner and substantially cylindrical outer cooling sleeve assembly where one end of said outer cooling sleeve is welded to said combustion liner, the method comprising:

a) determining a radial gap between said combination liner and said outer cooling sleeve as a function of operating temperatures and thermal expansion coefficients of said combustion liner and said outer cooling sleeve;

b) forming said outer cooling sleeve with a diameter sufficient to provide said radial gap;

c) swaging said end of said outer cooling sleeve to bring said end into engagement with said combustion liner; and d) welding said cooling sleeve to said liner about said end.

23. The method of claim 22 wherein said radial gap is sufficiently large so that, during operation, a residual gap will be maintained between said combustion liner and said outer cooling sleeve.

24. The method of claim 22 wherein said thermal expansion coefficients are identical.

25. The method of claim 22 wherein said weld is a continuous 360° weld about said edge.

26. The method of claim 22 wherein said end is circumferentially divided into segments and wherein said weld is continuous in each segment.

27. The method of claim 26 wherein said end is swaged inwardly an amount equal to said gap such that said end engages an outer surface of said combustion liner.

28. The method of claim 22 wherein said outer cooling sleeve has at least one circumferentially arranged row of cooling holes adjacent said end.

29. The method of claim 28 wherein said combustion liner has a circumferentially extending cooling groove substantially radially aligned with said at least one row of cooling holes.

30. The method of claim 29 wherein said combustion liner is provided with one or more axially extending cooling channels communicating with said cooling groove.

31. The method of claim 26 wherein said segments are formed by axially extending slots.

32. The method of claim 31 wherein said outer cooling sleeve has at least one circumferentially arranged row of cooling holes adjacent said end; and further wherein said axially extending slots communicate with respective ones of said cooling holes.

* * * * *

UNITED STATES PATENT AND TRADEMARK OFFICE

CERTIFICATE OF CORRECTION

PATENT NO. : 6,334,310 B1
DATED : January 1, 2002
INVENTOR(S) : Sutcu et al.

It is certified that error appears in the above-identified patent and that said Letters Patent is hereby corrected as shown below:

Title page,
Item [57], ABSTRACT,
Line 20, delete "With" and insert -- with --.

Column 1,
Line 62, delete "in" (second occurrence).

Signed and Sealed this

Twenty-eighth Day of January, 2003

JAMES E. ROGAN
*Director of the United States Patent and Trademark Office*